US011849820B2

(12) United States Patent
Kochisarli

(10) Patent No.: US 11,849,820 B2
(45) Date of Patent: Dec. 26, 2023

(54) LOCK ASSEMBLY FOR JEWELRY GROUPS

(71) Applicant: Can Kochisarli, Istanbul (TR)

(72) Inventor: Can Kochisarli, Istanbul (TR)

( * ) Notice: Subject to any disclaimer, the term of this patent is extended or adjusted under 35 U.S.C. 154(b) by 0 days.

(21) Appl. No.: 17/615,836

(22) PCT Filed: Jun. 20, 2020

(86) PCT No.: PCT/TR2020/050531
§ 371 (c)(1),
(2) Date: Dec. 2, 2021

(87) PCT Pub. No.: WO2021/183072
PCT Pub. Date: Sep. 16, 2021

(65) Prior Publication Data

US 2022/0304430 A1 Sep. 29, 2022

(51) Int. Cl.
*A44C 5/20* (2006.01)

(52) U.S. Cl.
CPC ..... *A44C 5/2066* (2013.01)

(58) Field of Classification Search
CPC ..... A44C 5/2066; A44B 11/266
See application file for complete search history.

(56) References Cited

U.S. PATENT DOCUMENTS

| | | | | |
|---|---|---|---|---|
| 215,956 | A * | 5/1879 | Miller | A44C 5/22 24/593.11 |
| 7,107,789 | B1 | 9/2006 | Bruner | |
| 7,117,569 | B2 * | 10/2006 | Bledsoe | A41F 1/008 24/593.11 |
| 10,159,291 | B1 * | 12/2018 | Ortega | A43C 11/12 |

FOREIGN PATENT DOCUMENTS

| | | | |
|---|---|---|---|
| CH | 594380 | A5 | 1/1978 |
| CN | 201995757 | U | 10/2011 |
| TR | 200703213 | A2 | 10/2007 |
| TR | 201307402 | | 10/2013 |
| TR | 201706301 | U | 7/2017 |

* cited by examiner

*Primary Examiner* — Robert Sandy

(57) ABSTRACT

A locking mechanism fastened at neck, ear and wrist areas with at least one male part body, includes a female part body, wherein the male part body is attached to the female part body. The locking mechanism includes a mounting opening, wherein the male part body is advanced towards a direction and placed in the mounting opening, moving jaws meeting to lock the male part body entering the mounting opening of the female part body, at least one retainer tab formed on the moving jaws, and male part teeth with tooth sockets, wherein the at least one retainer tab is seated on the tooth sockets.

8 Claims, 3 Drawing Sheets

LOCK ASSEMBLY FOR JEWELRY GROUPS

CROSS REFERENCE TO THE RELATED APPLICATIONS

This application is the national stage entry of International Application No. PCT/TR2020/050531, filed on Jun. 20, 2020, which is based upon and claims priority to Turkish Patent Application No. 2020/03618, filed on Mar. 9, 2020, the entire contents of which are incorporated herein by reference.

TECHNICAL FIELD

The invention relates to a lock assembly that allows fastening valuable jewelry such as necklaces, earrings and bracelets on the individual (around neck, on ear and around wrist).

The invention in question relates to a lock device which can be worn and fastened around the neck, on the ear and around the wrist and form a rigid structure without gaps on both ends easily and without effort.

BACKGROUND

Today, as is well known, valuable jewelry such as necklaces, earrings, bracelets are worn on body parts such as neck, wrist and ear. Fastening these valuable metals often involves a long time and trouble. Due to being sensitive and valuable items, elaborate mechanisms or assemblies are used for the lock parts.

The lock mechanisms used today for valuable jewelry such as necklaces, earrings, bracelets are made of multiple parts and include a noticeable elevation in the locking part. Another important disadvantage is the clothing to get snagged to the lock area and becoming a hindrance.

In a patent survey conducted on lock mechanisms of valuable jewelry, the application number TR2017/06301 has been found, and the summary part of this application states that; The invention relates to a tag comprising a ring made of plastic, an outer surface onto which information regarding the animal can be scribed with and laser, and clip elements with a male and a female in order to allow opening and closing, produced to be suitable for the legs of poultry, particularly hens, pigeons, quails and roosters and intended to be used for determining and monitoring ID information these animals.

Another application is the application number TR2013/07402; the invention relates to a lock system which allow wearing and taking off bracelets known as Trabzon woven bracelets easily and to be carried safely, while in addition allowing different buckles to be equipped depending on the environment. The Sliding Lock System with Changeable Buckle for Woven Bracelets of the invention is developed to allow the woven bracelets to be worn and taken off easily, carried safely and that the desired buckle depending on the liking can be attached under the woven bracelet. According to the mentioned purposes, The Sliding Lock System with Changeable Buckle for Woven Bracelets of the invention is comprises; a body, a Woven Bracelet, a Single Slot Wing, a Double Slot Wing, a Lock Pin, A Pin Slot, a Buckle, a Buckle Slot, and Buckle Fastening Shaft parts.

In the application number TR2007/03213; the invention is a lock system used in a functional women's necklace, wherein; a lock system developed as an improved version of a functional women's necklace for which we have applied before is mentioned.

SUMMARY

The purpose of the invention is to introduce a different lock system which brings a new aspect in this field, unlike the lock systems used in the current technique.

Another purpose of the invention is to provide easy, effortless and quick locking as a result of interlocking of both ends of the necklace, earring or wristband.

Another purpose of the invention is to obtain a rigid flat structure by engaging both ends of the necklace, earring or bracelet to each other. Thereby, it is to prevent formation of a rough structure on the jewelry and achieving a more aesthetic and holistic structure from a visual point of view. Another purpose of the invention is to obtain a distinctive structure compared to the lock systems used in the current technique.

Another important purpose of the invention is to provide a rigid locking without a gap by engaging the both ends to each other.

Another purpose of the invention is to eliminate the problem of sleeve parts of the clothes or other clothing surfaces to get snagged by the lock area comprising a flat structure.

In order to achieve the aforementioned purposes; it is a lock assembly fastened to the neck, ear and wrist part easily and effortlessly, comprising at least one male part body, and a female part body to which the mentioned male part body is attached, characterized by comprising;

- mounting opening where the mentioned male part body is advanced towards the direction (a) and placed,
- moving jaws that meet to lock the male part body entering the mentioned mounting opening of the said female part body,
- at least one retainer tab formed on the mentioned moving jaws and male part teeth having tooth slots where the mentioned retainer tabs are seated.

PART NUMBERS

Figure 1:
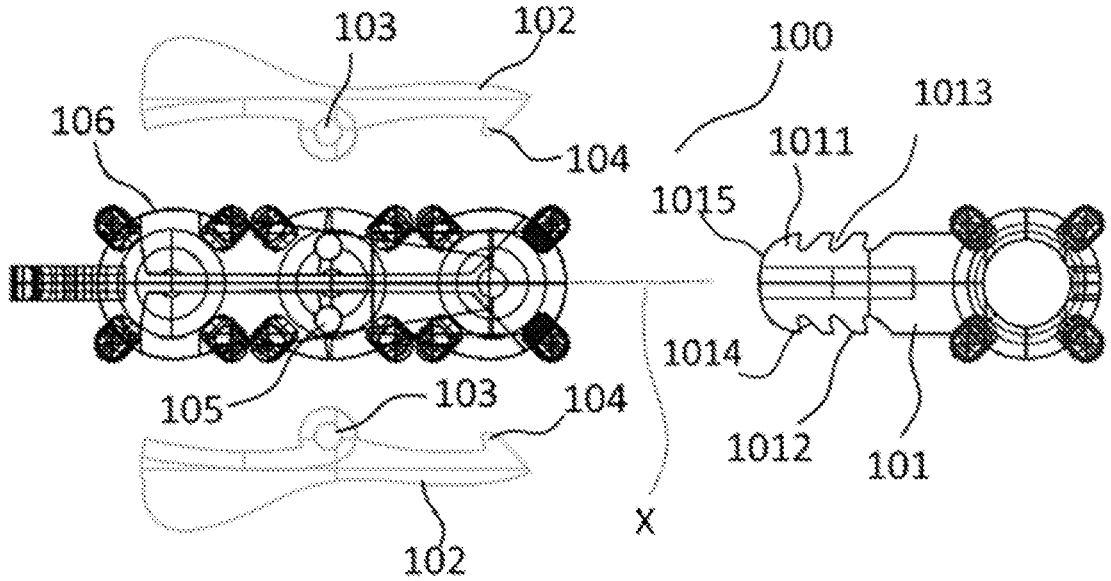
FIG. 1 is a two dimensional close-up view of the lock assembly of the invention in disassembled state.

100 Lock assembly
101 Male Part Body
1011 Male part head
1012 Male part teeth
1013 Tooth slots
1014 Angled surfaces
1015 Radial surfaces
102 Moving jaws
1021 Pressure surfaces
103 Bearing center
104 Retainer tab
105 Centering pin
106 Female Part body
107 Pushing element (Spring)

108 Mounting opening
200 Bracelet
300 Earring
a Mounting direction
x Main axis
b Print direction
c lock active

Detailed Description of the Embodiments

Figure 2:
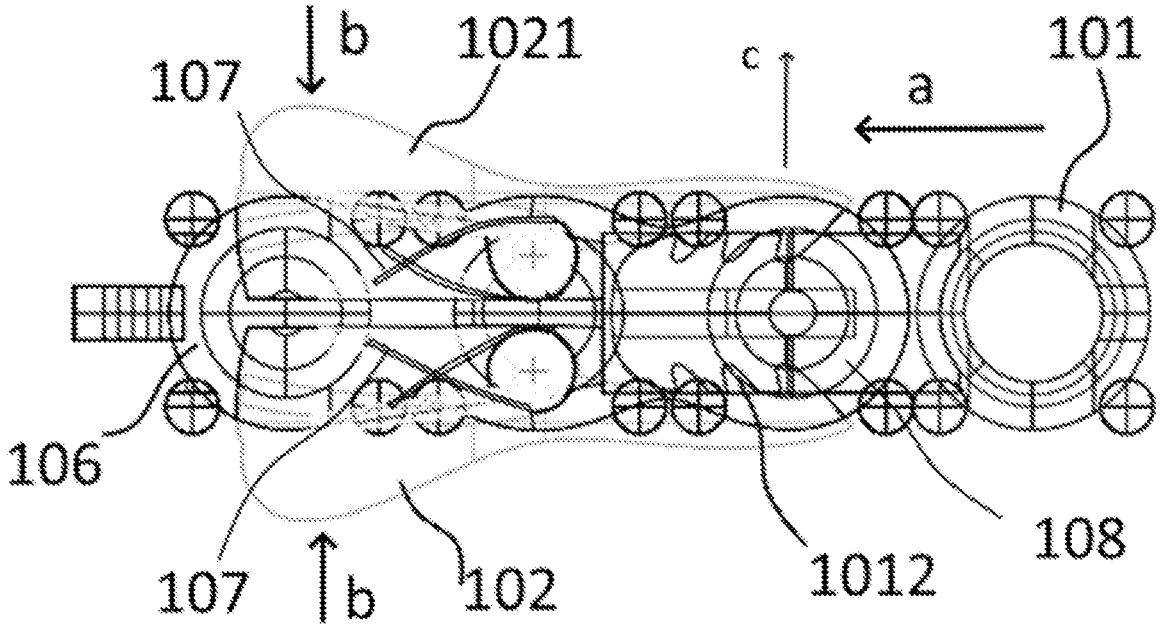
FIG. 2 is a two dimensional close-up view of the lock assembly of the invention in assembled state when the lock is active.

In FIGS. 1 and 2, a locking mechanism (100) which can be fastened at the neck, ear and wrist areas easily and effortlessly, with at least one male part body (101), comprising a female part body (106) to which the mentioned male part body (101) is attached. The lock assembly (100) in question contains the mounting opening (108) where the mentioned male part body (101) is moved in the direction of mounting (a) and placed and the moving jaws (102) which meet to lock the male part body (101) entering into the mounting opening (108) of the mentioned the female part body (106). In addition, it contains at least one retainer tab (104) formed on the mentioned moving jaws (102) and male part teeth (1012) with tooth sockets (1013) in which the mentioned retainer tabs (104) are seated.

On the other hand, the mentioned male part teeth (1012) contain V—shaped angled surfaces (1014) towards the main axis (x) and moving jaws (102) that are moved independently from each other. Pushing elements (107) which apply continuous force to the moving jaws (102) and at least one centering pin (105) formed on the mentioned female part body (106) is integrated to the assembly. In addition, it comprises bearing center (103) seated on the centering pin (105) and providing rotational motion about this point by means of this centering area and male part teeth (1012) a plurality of which is formed on the male part head (1011) and configured at a reverse angle with respect to the retainer tab (104).

Locking the lock assembly (100) is as follows; the male part body (101) is drawn or pushed in the direction of mounting (a) towards the mounting mouth (108) of the female part body (106). With this pushing motion, the radial surfaces of the male part head (1011) (1015) hit the retainer tabs (104), and the rounded surfaces of the radial surfaces (1015) allow the retainer tabs (104) to sit in the tooth sockets (1013) by making a sliding motion on this surface. The pressure elements (107) which provide the retainer tabs (104) to be seated in the tooth slots (1013) after the seating motion of the retainer tabs (104) into the tooth slots (1013) and act as springs perform compression motion by continuously applying force motion in this area. Thereby, the desired locking process is realized. If the lock is to be opened, as a result of a finger motion exerted on the pressure surfaces (1021) along the direction of pressure (b), the spring (107) force is overcome, and with the spring (107) force rendered ineffective, retainer tabs (104) of the moving jaws (102) open towards the direction (c), and the lock becomes deactivated (c). The retainer tabs (104) are opened in the direction (c) and separated from the male part teeth (1012) and thus the freed male part body (101) is pulled back and removed from the lock area completely.

Figure 3:
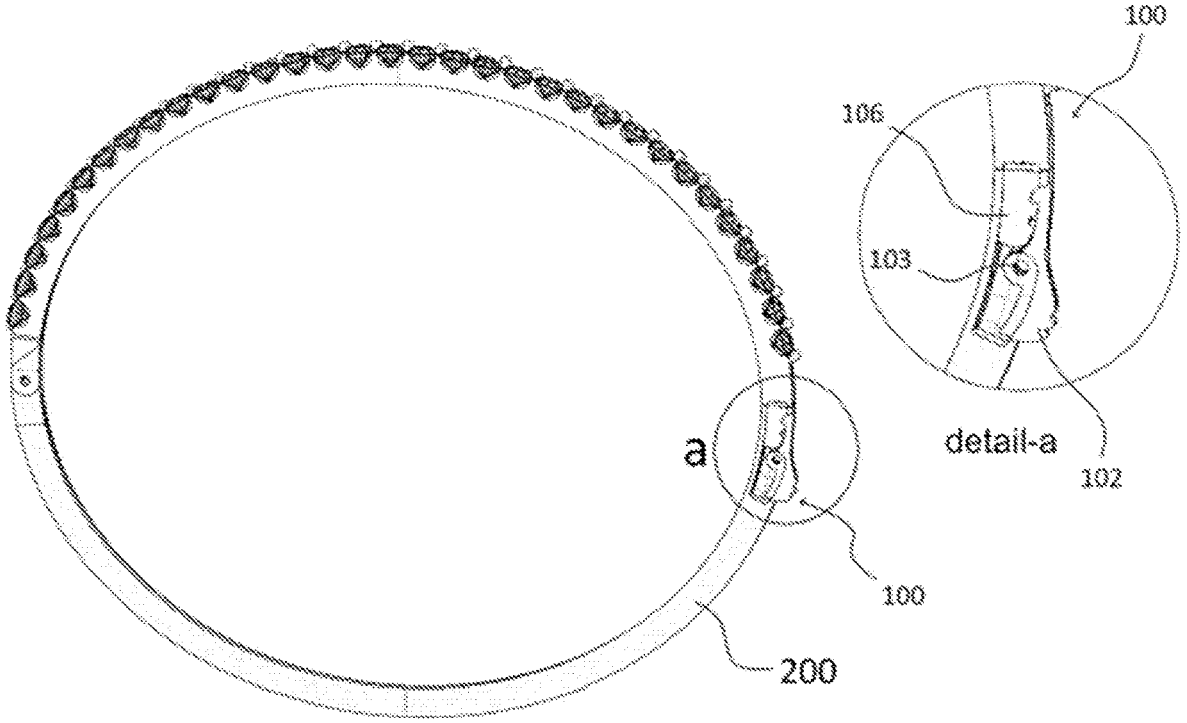
FIG. 3 is a representational view of the lock assembly of the invention with the detail—a, when it is applied to a bracelet.

In FIG. 3, a representational view of the lock assembly (100) with the detail—a, when it is applied to a bracelet (200), and a close-up view of the detail—a are illustrated. The male part body (101) of locking device (100) applied here is single and comprises a single moving jaw (102). However, it is possible to use two-sided or one-sided female part body (106) and male part body (101) depending on the jewelry to be used.

Figure 4:
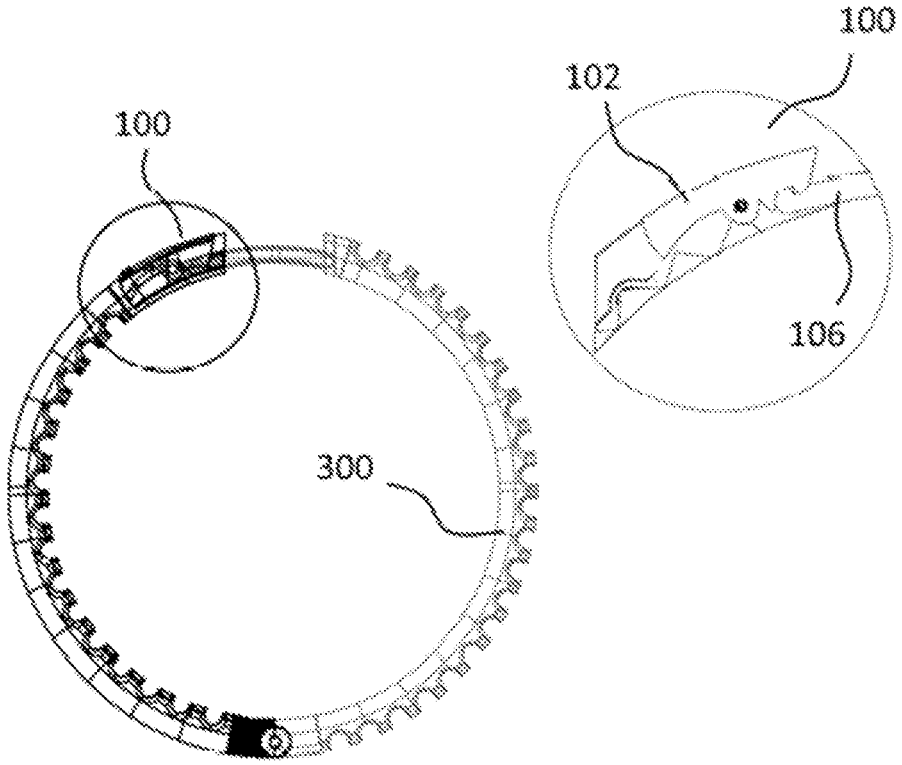
FIG. 4 is a representational view of the lock assembly of the invention with the detail—a, when it is applied to a necklace.

In FIG. 4, a representational view of the lock assembly (100) with the detail—a, when it is applied to an earring (300), and a close-up view of the detail—a are illustrated. The male part body (101) of locking device (100) applied here is single and comprises a single moving jaw (102). However, it is possible to use two-sided or one-sided female part body (106) and male part body (101) depending on the jewelry to be used.

What is claimed is:

1. A lock assembly for a jewellery configured to be fastened at neck, ear and wrist areas, the lock assembly comprising:

at least one male part body and at least one female part body, wherein the at least one male part body is attached to the at least one female part body, wherein the at least one female part body comprises at least one centering pin and a pushing element coupled to the at least one centering pin, and wherein the at least one male part body comprises tooth slots;

a mounting opening formed in the at least one female part body, wherein the at least one male part body with the tooth slots is advanced towards a direction and placed in the mounting opening;

moving jaws, each of the moving jaws comprises at least one retainer tab, wherein the at least one retainer tab of the moving jaws meets to lock with the tooth slots of the at least one male part body entering the mounting opening of the at least one female part body, and a bearing center to be seated on the centering pin to provide rotational motion about the at least one centering pin, and wherein the pushing element that is provided on the centering pin is configured to apply continuous force to the moving jaws and the at least one centering pin to provide the retainer tabs to be seated in the tooth slots to lock the at least one male part body with at least one female part body.

2. The lock assembly according to claim 1, comprising V-formed angled surfaces towards a main axis of the male part teeth.

3. The lock assembly according to claim 1, wherein the moving jaws are configured to move independent of each other.

4. The lock assembly according to claim 1, wherein the at least one male part teeth are formed on a male part head and configured at a reverse angle with respect to the at least one retainer tab.

5. The lock assembly according to claim 4, wherein the male part head comprises radial surfaces.

6. The lock assembly according to claim 1, wherein the pushing element continuously exert the force motion and a pressure motion on the at least one retainer tab towards a main axis, and the at least one retainer tab is at an opposite angle with respect to the male part teeth.

7. The lock assembly according to claim 1 comprising pressure surfaces, wherein a finger action towards a direction of a pressure is applied on the pressure surfaces to open the lock assembly.

8. The lock assembly according to claim 1 comprising a two-sided female part body or a one-sided female part body and the at least one male part body depending on a jewelry to be used.

* * * * *